US006883555B1

(12) United States Patent
Speich

(10) Patent No.: US 6,883,555 B1
(45) Date of Patent: Apr. 26, 2005

(54) DEVICE FOR PRODUCING A TUBULAR BELT BAND THAT CAN BE TURNED INSIDE OUT

(75) Inventor: Francisco Speich, Gipf-Oberfrick (CH)

(73) Assignee: Textilma AG, Hergiswil (CH)

( * ) Notice: Subject to any disclaimer, the term of this patent is extended or adjusted under 35 U.S.C. 154(b) by 0 days.

(21) Appl. No.: 10/168,168

(22) PCT Filed: Dec. 16, 1999

(86) PCT No.: PCT/CH99/00606

§ 371 (c)(1),
(2), (4) Date: Jun. 17, 2002

(87) PCT Pub. No.: WO01/44547

PCT Pub. Date: Jun. 21, 2001

(51) Int. Cl.[7] ..... D03J 1/22

(52) U.S. Cl. ..... 139/294; 139/296; 139/305; 139/384 R; 139/387 R

(58) Field of Search ..... 139/294, 295, 139/296, 298, 305, 384 R, 387 R, 388, 389, 390

(56) References Cited

U.S. PATENT DOCUMENTS

| | | | | |
|---|---|---|---|---|
| 3,155,121 A | * | 11/1964 | Seltzer et al. | 139/389 |
| 3,331,402 A | * | 7/1967 | Kathriner et al. | 139/291 R |
| 3,563,282 A | * | 2/1971 | Gonon | 139/390 |
| 4,205,709 A | | 6/1980 | Duschek | |
| 4,385,648 A | * | 5/1983 | Bindhoff | 139/384 R |
| 5,021,283 A | * | 6/1991 | Takenaka et al. | 428/116 |
| 5,070,912 A | * | 12/1991 | Ludwig | 139/188 R |
| 5,115,839 A | | 5/1992 | Speich | |
| 5,592,977 A | * | 1/1997 | Kikuchi et al. | 139/387 R |
| 5,651,395 A | * | 7/1997 | Graham et al. | 139/390 |
| 5,685,347 A | * | 11/1997 | Graham et al. | 139/390 |
| 6,007,092 A | | 12/1999 | Martz | |

FOREIGN PATENT DOCUMENTS

| | | |
|---|---|---|
| DE | 1 610 812 | 4/1971 |
| EP | 363 490 | 4/1990 |
| EP | 534 300 | 3/1993 |
| WO | WO89/02491 | 3/1989 |
| WO | WO 98/51845 | 11/1998 |
| WO | WO99/40247 | 8/1999 |

OTHER PUBLICATIONS

Copy of a portion of a book published by Sauerländer entitled "Narrow Fabric Weaving" written by Hans Walter Kipp, Copyright 1989, pp. 1, 5, 6, and 180–221.

* cited by examiner

*Primary Examiner*—John J. Calvert
*Assistant Examiner*—Robert H. Muromoto, Jr.
(74) *Attorney, Agent, or Firm*—Ostrolenk, Faber, Gerb & Soffen, LLP

(57) ABSTRACT

A device for producing at least two tubular belt bands that are turned inside out, where each of the belt bands has two fabric layers on top of one another and connected to each other in a longitudinal direction by woven hems to form a cavity. Warp threads of the layers have a uniform warp thread density over an entire length of the belt bands. The device includes a power loom having a shedding mechanism with a reed with parallel dents, a weft insertion device extending over an entire width of the power loom, a control unit for controlling the shedding mechanism, and an expander extending over the entire width of the power loom. The expander has a smaller diameter in a tubular area than in a hem area in correspondence with the belt bands to be produced so that clamping pressure of the expander is substantially constant over an entire width of the woven fabric. A thermal cutting device has cutting heads that are operative to cut out the belt bands in the hem area from the woven fabric web.

17 Claims, 9 Drawing Sheets

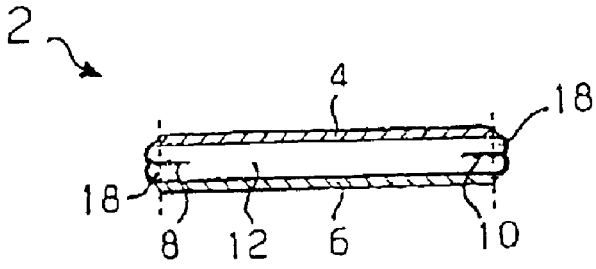
Fig. 1
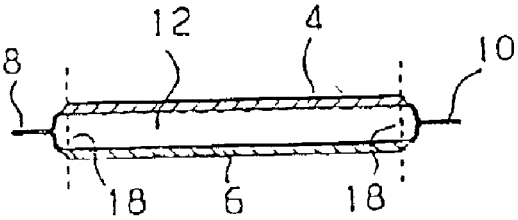
Fig. 2
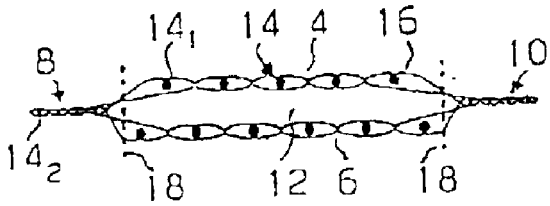
Fig. 3
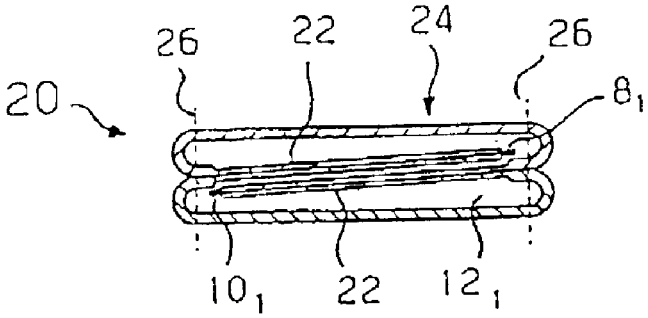
Fig. 4
Fig. 6
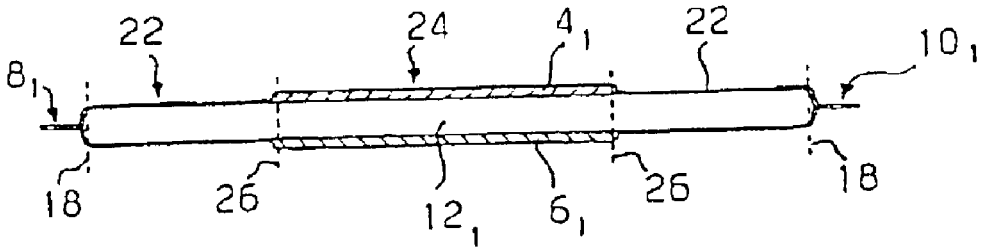

DEVICE FOR PRODUCING A TUBULAR BELT BAND THAT CAN BE TURNED INSIDE OUT

PRIORITY CLAIM

This is a U.S. national stage of application No. PCT/CH99/00606, filed on Dec. 16, 1999. Country: Switzerland. Priority is claimed on that application.

BACKGROUND OF THE INVENTION

1. Technical Area

The invention pertains to a device for producing at least two tubular belt bands which can be turned inside-out.

2. State of the Art

WO 98/51,845 describes a tubular band and a device for its production on a power loom. The power loom has a reed, the dents of which form a gap, which tapers down from the top toward the bottom. The reed can be moved up and down, as a result of which the warp threads arrive in areas where they are spread out to different degrees (areas of different density), so that a tubular band of varying width can be produced. For this purpose, it is also necessary that the fabric be guided by expanders along the two long edges, preferably immediately after the woof thread has been beaten. The widening effect of the expanders can be controlled in synchrony with, and essentially in proportion to, the increase or decrease in the distance between the warp threads. It is possible to produce a number of different seamless variants of this type of tubular band. For one of these variants, it is proposed that the tubular band be produced on a power loom as a wide, multiple-use fabric with a seam and that it then be cut into individual tubular bands by a thermal cutting device. Because of the considerable change in the density of the warp threads by the reed, however, there is considerable doubt that a usable wide fabric can be produced, since there is a considerable amount of additional compression and decompression between the adjacent tubular bands.

Aside from the fact that the device and the production method are extremely complicated, the density of the warp threads changes in correspondence with the degree of spreading by the reed, which means that structure of the fabric is looser in the wider areas than in the narrower ones. As a result, the tubular band which is obtained has a relatively coarse structure, especially in the wider areas, and its strength is also limited correspondingly. In particular, a tubular fabric of this type is not suitable as a belt band nor as an inflatable auto safety belt, because such belt bands must absorb longitudinal forces, that is, forces which proceed in the restraining direction. Because the arrangement of the warp threads varies with their density, the threads are neither parallel to each other nor straight, as a result of which longitudinal forces cannot be absorbed efficiently; on the contrary, they cause a change in the length and/or a deformation of the belt band. In addition, the hem of the tubular band is on the outside, which is not only unsightly but also dangerous because of its hard edge, which can cause injury.

A woven belt band which is suitable as an inflatable belt band for auto safety belts is described in WO 99/40,247. The disadvantage here is that this fabric either must be woven as a round fabric or it must have two woven layers, which are connected to each other along at least one side by a woven hem. The belt band must be assembled to form several layers by a complicated process, not only to make it suitable as a belt band but also to hide the unsightly and dangerous hem.

DESCRIPTION OF THE INVENTION

The task of the invention is to provide a device for producing a tubular belt band which can be turned inside out, this device making it possible to produce the belt band easily and efficiently.

This task is accomplished by a device having a power loom with a shedding mechanism having a reed with parallel dents, a woof insertion device that extends over an entire width of the power loom, and a control unit for controlling the shedding mechanism. The power loom further includes an expander that extends over the entire width of the power loom. The expander has a smaller diameter in a tubular area than in a hem area in correspondence with the belt bands to be produced so that the clamping pressure of the expander is substantially constant over an entire width of the woven fabric web. The device further includes a thermal cutting device having cutting heads operative to cut out the belt bands in the hem area from the woven fabric web. First, because the belt band is produced on a power loom with parallel dents and because the shape of the cavity is determined only by the production of the hem, it is simple to produce; and second, because the warp threads are exactly parallel to each other and thus do not undergo any change in length or position under load, a very strong and durable belt band is obtained. The expander, which extends over the entire width of the fabric, has a smaller diameter in the area of the tubular band than it does in the area of the hem, which ensures that the fabric is clamped uniformly over its entire width and that the woven fabric web takes a smooth course with little or no distortion and thus that the fabric can be produced satisfactorily in spite of different thicknesses and densities of the weave. In addition, production is especially efficient because of the multiple use which is now possible; that is, at least two belt bands can be produced simultaneously in the woven web.

Because the belt band can be turned inside out, the woven hem can be made to lie on the inside by reversing the inside and outside surfaces. The woven belt band thus obtained is not only visually attractive but also highly advantageous in use. Because the edge of the belt band is rounded, it looks attractive and is also convenient and safe to use. In particular, these positive properties make it suitable as an inflatable auto safety belt.

There are many different types of power looms which can be used to produce the band. For example, those with air or water nozzles and also those with gripper or projectile type insertion mechanisms for inserting the woof can be used.

The belt band is suitable for a wide variety of uses. For example, it is suitable for air or water bags and for air or water hoses. It is also suitable as strapping or as safety belt material for vehicles and is especially suitable for inflatable auto safety belts.

BRIEF DESCRIPTION OF THE DRAWINGS

Exemplary embodiments of the invention are described in greater detail below on the basis of the drawings:

FIG. 1 shows a cross section of a belt band turned inside out;

FIG. 2 shows a cross section of the belt band according to FIG. 1 before it has been turned inside out;

FIG. 3 shows the belt band of FIG. 2 with the arrangement of the threads made evident;

FIG. 4 shows another cross section of an inside-out belt band with cavity sections of different widths;

FIG. 6 shows a cross section of the belt band of FIG. 5 along line VI—VI of FIG. 5;

DETAILED DESCRIPTION OF THE PREFERRED EMBODIMENTS

Figure 5:
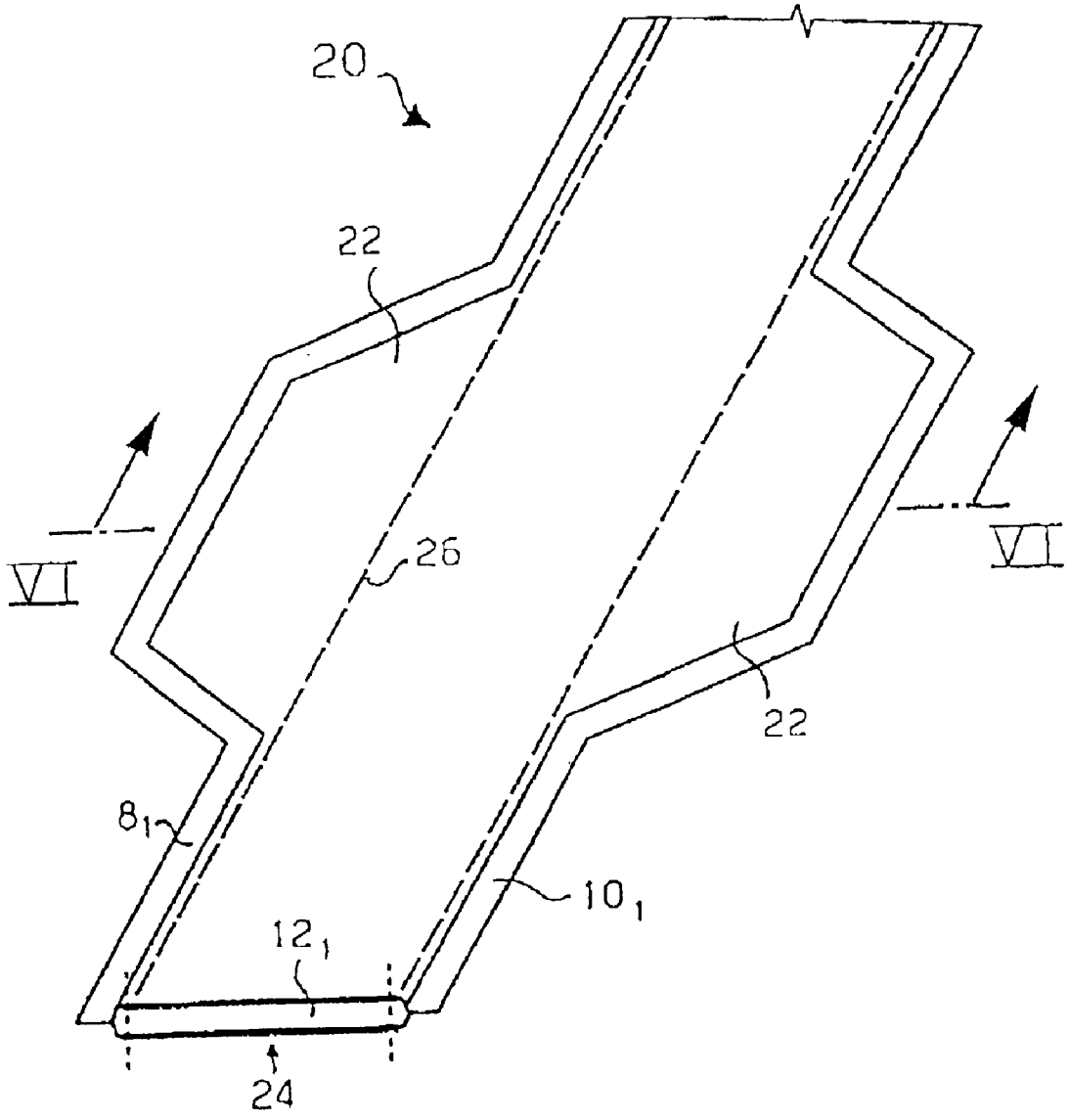
FIG. 5 shows a diagram of the belt band of FIG. 4 before it has been turned inside out.

FIGS. 1–3 show a first belt band 2, which is formed out of an upper fabric layer 4 and a lower fabric layer 6, which are connected to each other by hems 8 and 10, one on each side, and which enclose between them a cavity 12. In the present example, the hems 8, 10 are parallel to each other, and thus the width of the cavity 12 whose boundaries they form remains uniform over the entire length. FIGS. 2 and 3 show the belt band after production but before it has been turned inside out, whereas FIG. 1 shows the read-for-use inside-out state, that is the state after the belt band of FIG. 2 has been turned inside out and the hems 8, 10 are no longer on the outside but on the inside.

As can be seen in FIG. 3, the belt band is formed by warp threads 14, which are connected to each other by woof threads 16. The warp threads $\mathbf{14}_1$ of the cavity area 12 are preferably thicker than the warp threads $\mathbf{14}_2$ of the hems 8, 10. All of the warp threads are parallel to each other, but the warp threads $\mathbf{14}_2$ of the hems 8, 10 are arranged with greater density than the warp threads $\mathbf{14}_1$ of the fabric layers 4, 6 of the cavity 12. The thicker warp threads $\mathbf{14}_1$ of the fabric layers 4, 6 serve in particular to transmit force in the longitudinal direction of the belt band. To increase the safety, the fabric layers 4, 6 are connected to each other at the transition points to the hem 8, 10 by tie-off threads 18, which help to prevent unintentional separation of the hem.

The belt band 20 shown in FIGS. 4–6 is essentially the same as the belt band of FIGS. 1–3, and the thus same parts have been provided with the same reference numbers. In contrast to the belt band 2 of FIGS. 1–3, however, the belt band 20 has areas 22 along the sides, in which the belt band 20 and the cavity $\mathbf{12}_1$ have been widened. In these lateral areas 22, the warp threads (not shown) are thinner than they are in the central area 24, preferably having the same thickness as the warp threads of the hems $\mathbf{8}_1$ and $\mathbf{10}_1$. On the side facing the cavity $\mathbf{12}_1$, these hems $\mathbf{8}_1$ and $\mathbf{10}_1$ have tie-off threads 18. The fabric layers $\mathbf{4}_1$ and $\mathbf{6}_1$ are also connected to each other by tie-off threads 26 at the transition points to the lateral areas 22 to facilitate the process of turning the band inside-out. These tie-off threads 26, however, are designed as breakable threads, which break when the cavity $\mathbf{12}_1$ is inflated, which is the case, for example, when a belt band of this type is used as an inflatable auto safety belt. FIGS. 5 and 6 show the belt band 20 after it has been produced but before it has been turned inside out; FIG. 4 shows it after turning.

The inside or the outside of the belt bands 2 and 20 can be provided with a coating to prevent or limit the passage of fluid.

Figure 7:
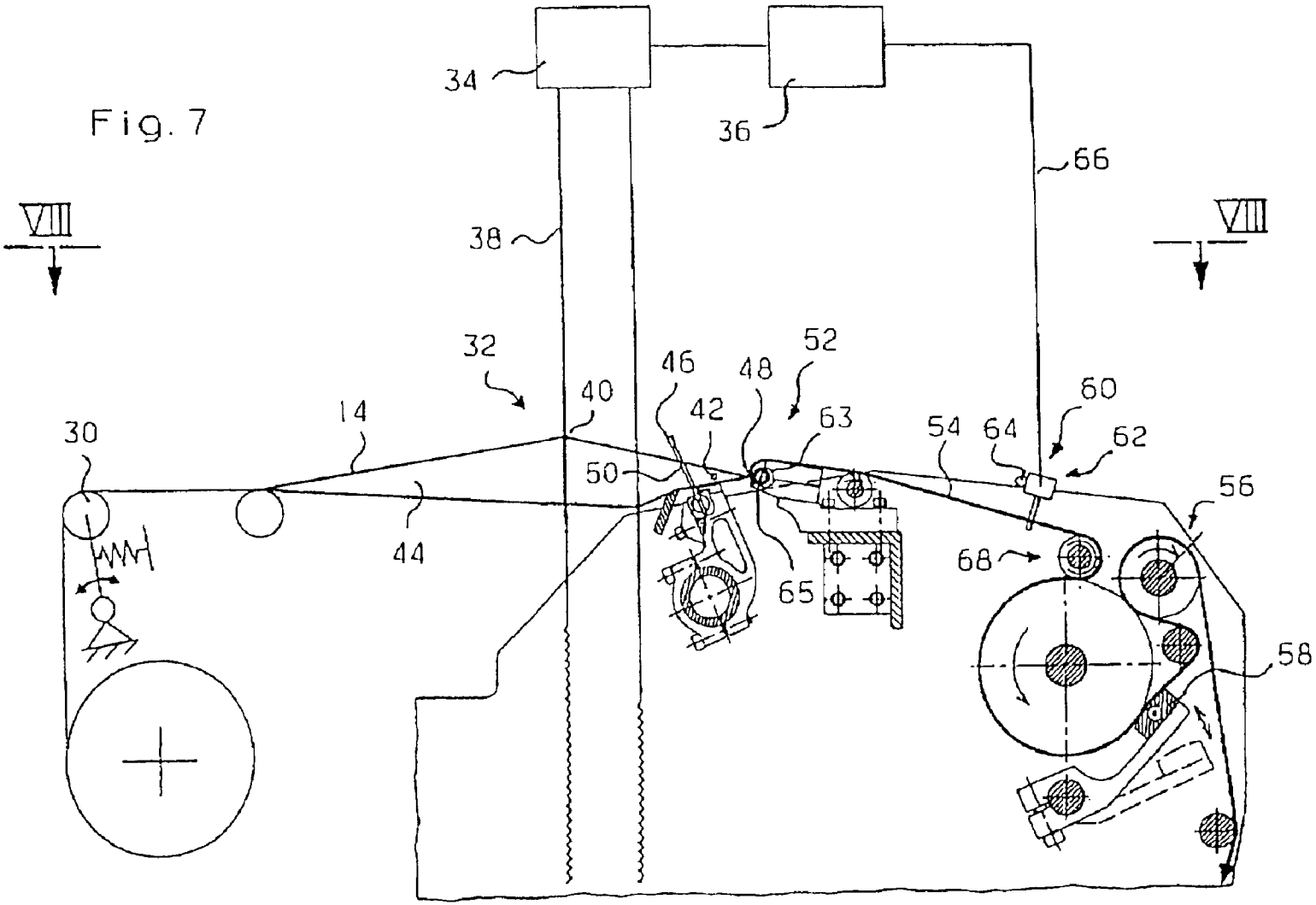
FIG. 7 shows a schematic diagram of a side view of a power loom used for the production of the belt band.
Figure 8:
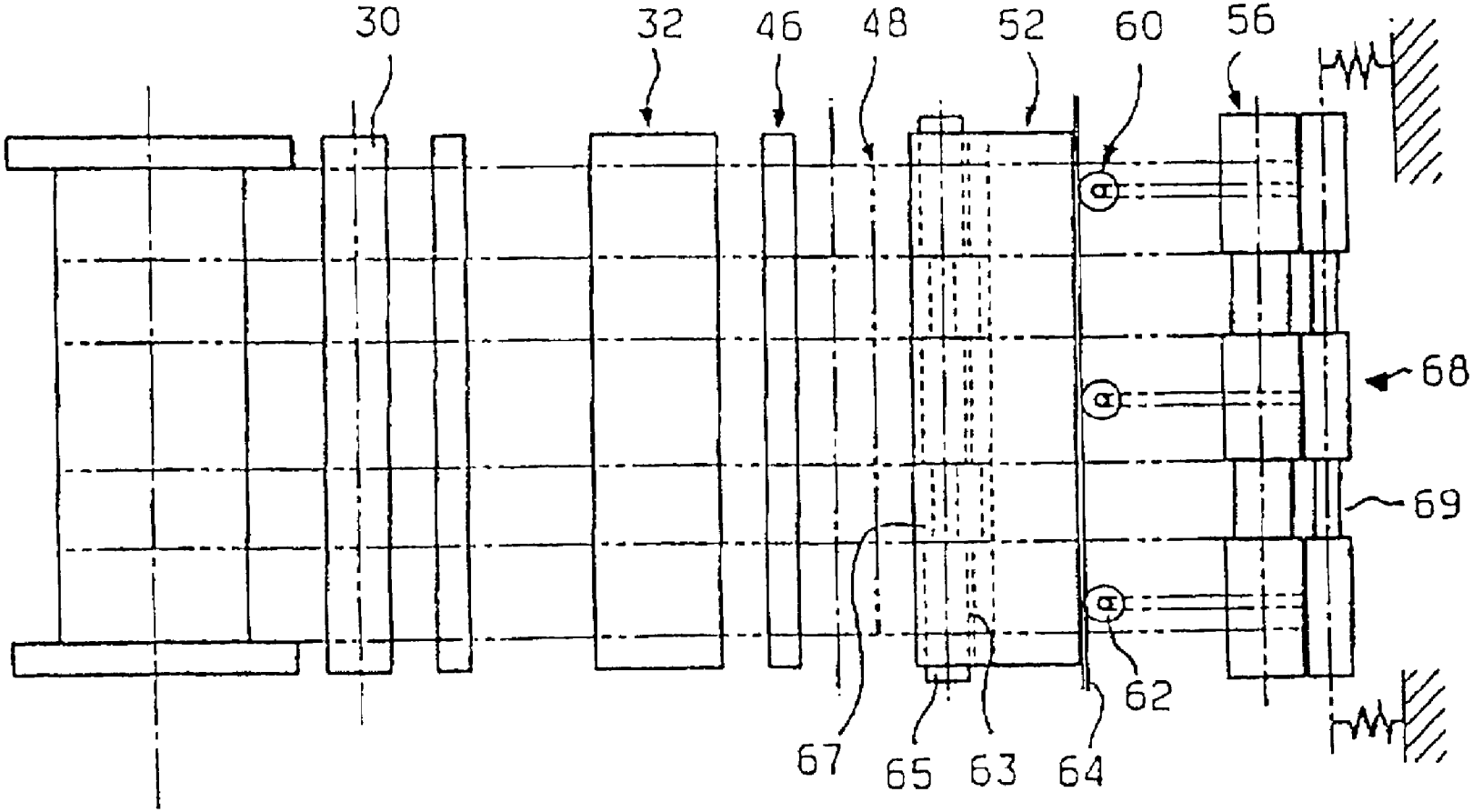
FIG. 8 shows a top view of the power loom of FIG. 7 along line VIII—VIII of FIG. 7.
Figure 9:
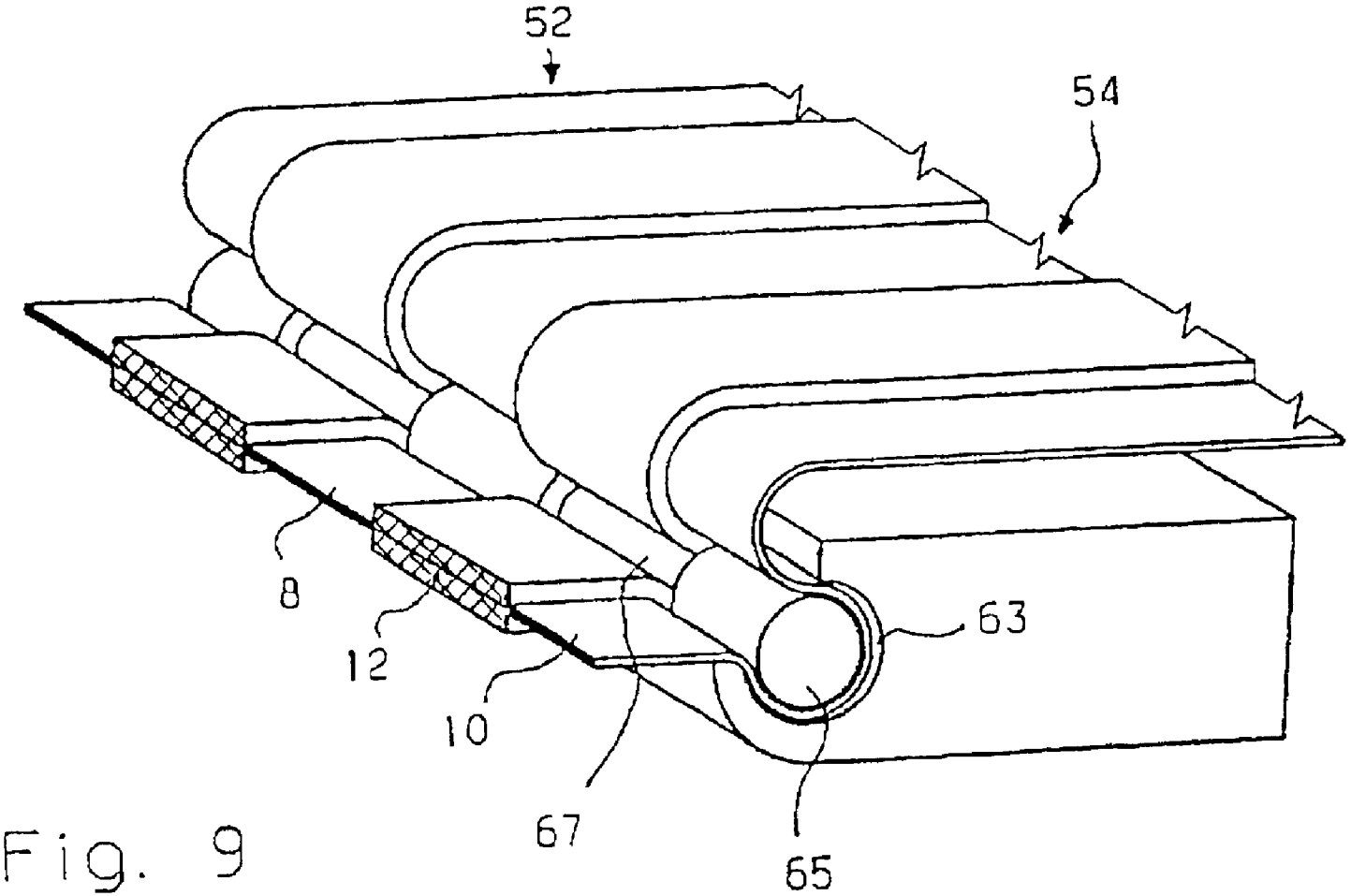
FIG. 9 shows a partial cutaway schematic diagram of the expander of the power loom of FIG. 8 in detail, on a larger scale.

FIGS. 7–9 show a schematic diagram of a power loom for producing the belt bands 2 and 20. The warp threads 14 are introduced via the warp beam 30 of a shedding mechanism 32; this mechanism comprises a Jacquard machine 34, which can be controlled by a computer-controlled electronic control unit 36 in accordance with the desired pattern. The Jacquard machine 34 contains heddles 38, which act via eyes 40 to control the individual warp threads 14. A woof insertion device (not shown) is provided to insert the woof threads 42 into the shed 44 opened by the shedding mechanism 32; the reed 46 then beats them at the fabric edge 48. The reed 46 comprises an arrangement of parallel dents 50, which ensures that the warp threads 14 are kept parallel to each other. The woven web thus obtained then passes through an expander 52, which keeps the woven web 54 at the desired width. A fabric take-up device 56 supplies the required longitudinal tension on the woven web on the power loom and guides the web to a take-up container (not shown) or a corresponding fabric beam. The fabric take-up device 56 has a heat-setting device 58 associated with it to free the woven web thus produced of tension before the fabric leaves the fabric take-up device. How hollow fabric can be produced with a power loom of this type belongs to the state of the art and is described in, for example, Hans Walter Kipp, Bandwebtechnik [Band Weaving Technology], JTM-Stiftung Frick, 1988, pp. 180 ff.

Between the expander 52 and the fabric take-up device 56, the power loom has a thermal cutting device 60, equipped with as many cutting heads 62 as there are cuts to be made lengthwise through the woven web 54. For straight cuts, the cutting heads can be permanently mounted on a carrier 64. If the cutting heads 62 are intended to produce figured cuts, however, then they are designed so that can be moved along the carrier 64 and thus crosswise, for example, to the travel direction of the woven web. These movements can be controlled by the control unit 36 in accordance with the desired pattern, as directed by the signals passing over the control line 66.

As can be derived from FIGS. 8 and 9, the expander 52 has a profile which corresponds to the belt band to be produced. Thus, a clamping rod 65 of the expander 52 is installed in a slot 63 and has recesses 67 in the areas assigned to the cavities 12. These recesses reduce the pressure applied there, whereas greater pressure is applied in the areas of the hems 8, 10, with the result that the pressure is essentially uniform over the entire width, and the fabric web 54 proceeds along its course smoothly and with little or no distortion. For the same reason, a press roll 68 of the fabric take-up device 56 is also profiled with recesses 69 in the areas assigned to the cavities 12.

Figure 10:
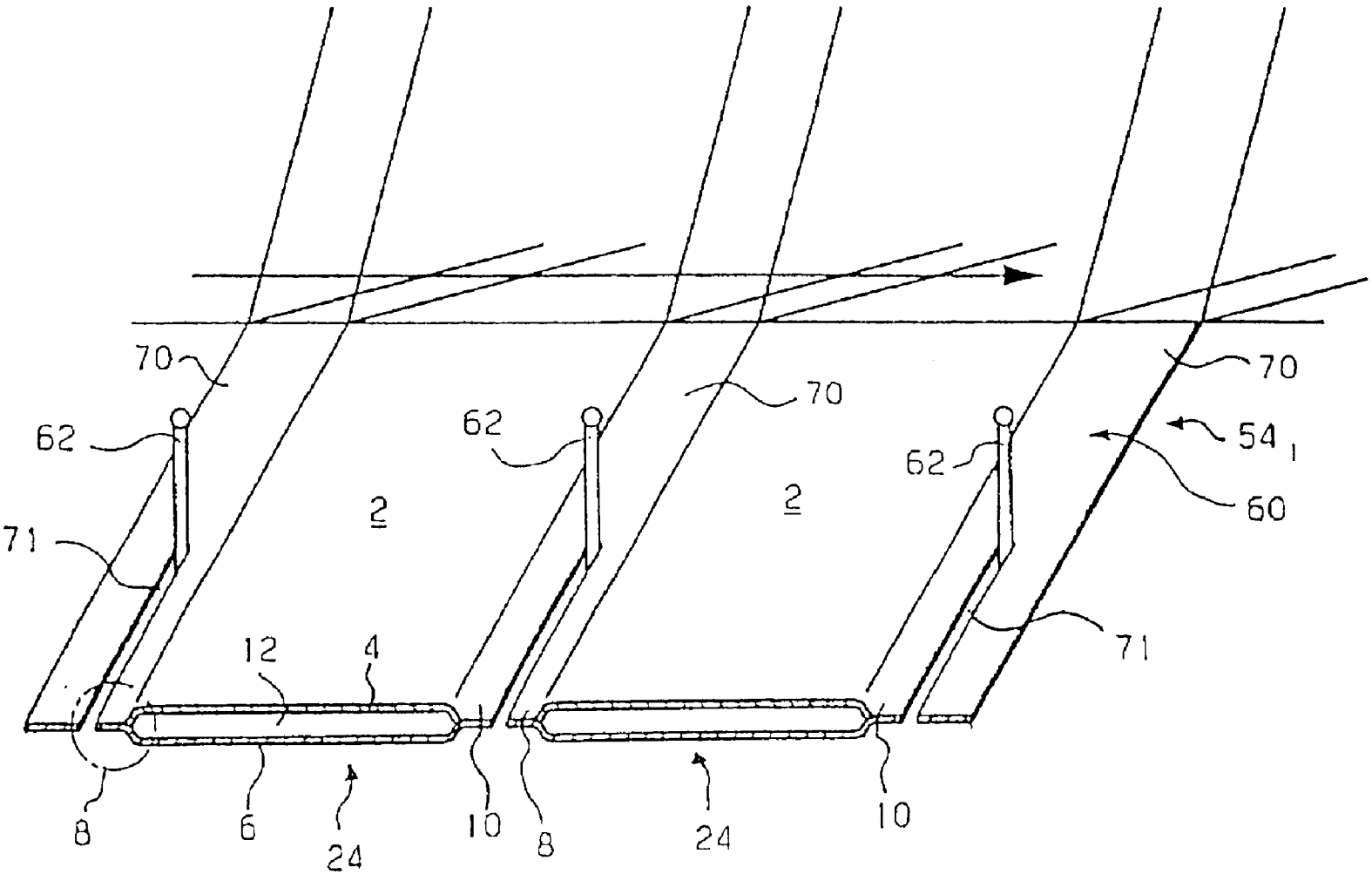
FIG. 10 shows a schematic diagram of the production of the belt band of FIG. 1 by cutting a wide fabric web into individual belt bands.

FIG. 10 shows a schematic diagram of the production of two belt bands 2 from a fabric web $\mathbf{54}_1$. Because the belt band 2 has a central area 24 and hems 8, 10 of uniform width, the cutting heads 62 of the thermal cutting device 60 can be adjusted permanently to a fixed spacing. The cutting heads 62 make parallel cuts 71 through the hem areas 70 at the side of the belt bands 2, so that the hems 8 and 10 are formed.

Figure 11:
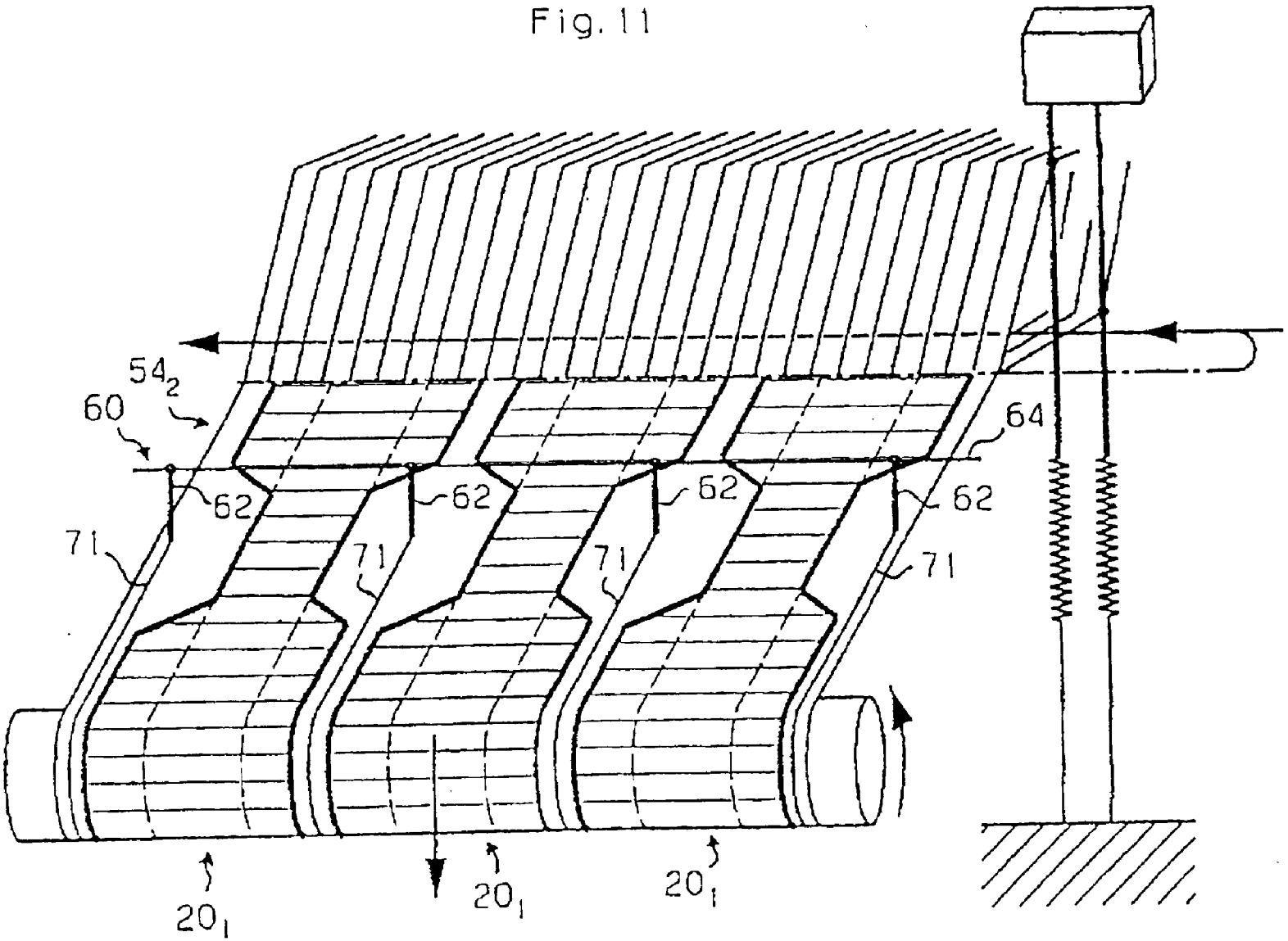
FIG. 11 shows a schematic diagram of a first variant of the production of a belt band of FIGS. 4–6 by making straight cuts through a wide fabric web.

In a diagram similar to that of FIG. 10, FIG. 11 shows the production of belt bands $\mathbf{20}_1$ with cavities $\mathbf{12}_1$ of varying width according to FIG. 5 from a woven web $\mathbf{54}_2$, where the adjacent belt bands $20_1$ are parallel to each other. Because the woven web is separated by parallel cuts 71, the cutting heads 62 are attached permanently the appropriate distance apart so a carrier 64.

Figure 12:
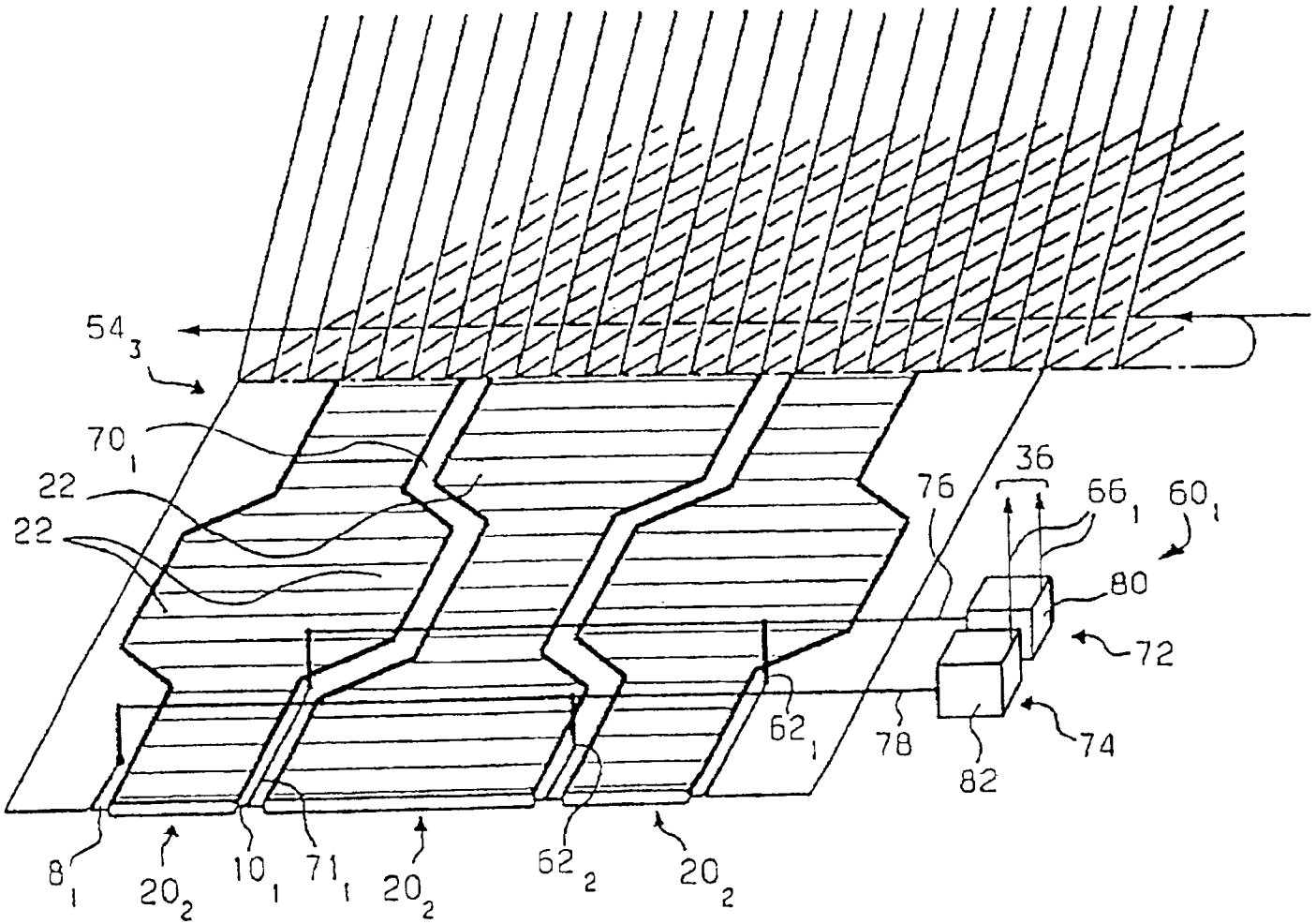
FIG. 12 shows a second variant of the production of a belt band of FIGS. 4–6 by cutting through the center of the hem area between two belt bands of a wide fabric web.
Figure 13:
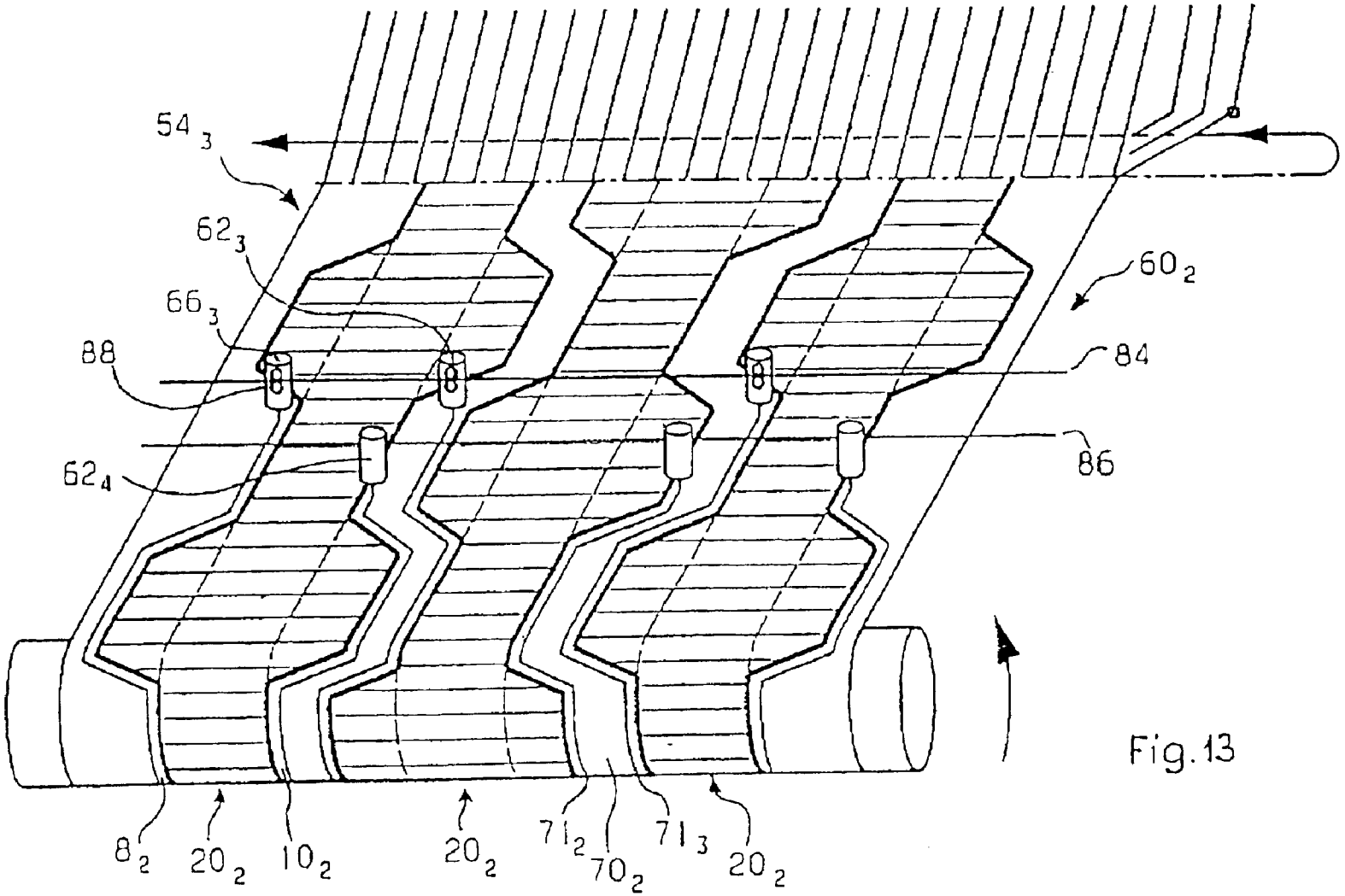
FIG. 13 shows a schematic diagram of a third variant of the production of a belt band of FIGS. 4–6 by cutting the hem area between two belt bands of a wide fabric web by the use of two cutting heads per hem.

FIGS. 12 and 13 show the production of belt bands $20_2$ from a woven web $54_3$ by means of the power loom according to FIGS. 7–9; however, the lateral areas 22 of adjacent belt bands are now offset with respect to each other in order to increase efficiency and to reduce the waste of the production process. These belt bands $20_2$ can be cut in two different ways. In the variant according to FIG. 12, only one cutting head is used per hem area. This makes a single cut 71 through the hem area $70_1$ approximately half way between the belt bands $20_2$ and in any case produces hems $8_1$, $10_1$ of different width. In the other variant according to FIG. 13, two cutting heads are provided per hem area $70_2$, which make two cuts $71_2$, $71_3$ and produce hems $8_2$, $10_2$ of the same width.

In the embodiment according to FIG. 12, the thermal cutting device $60_1$ has two cutting units 72, 74, each of which comprises a row of cutting heads $62_1$, $62_2$ for each cutting pattern. The heads can be moved synchronously and simultaneously with each other in correspondence with the contour of the hems $8_1$, $10_1$ to be produced. For this purpose, the cutting heads of each cutting unit 72, 74 are attached to a common carrier 76, 78, which can be moved by an actuator 80, 82 transversely to the travel direction of the woven web $54_1$, that is, transversely to the warp threads, in accordance with the selected pattern. For this purpose, the actuators 80, 82 receive their control pulses over control lines $66_1$ from the control unit 36.

In the embodiment of FIG. 13, a thermal cutting device with two cutting heads $62_3$, $62_4$ for each hem area is provided. These heads can be moved back and forth individually in accordance with the selected pattern, so that belt bands $20_2$ with hems $8_2$, $10_2$ of uniform width can be cut out. The cutting heads are mounted with freedom to move on stationary carriers 84, 86; and each one has, for example, a stepping motor (not shown), which can be controlled by a control device 36 acting via a control line $66_3$. The stepping motor turns a drive wheel 88, which acts on the carrier and thus moves the cutting head along the carrier.

In the present exemplary embodiments, the cutting devices are mounted directly on the power loom. It is quite possible, however, simply to produce the woven web on the power loom first and then to cut it into the desired belt bands by means of a cutting device separate from the loom.

What is claimed is:

1. A device for producing at least two tubular belt bands which can be turned inside out, where each of the belt bands has two fabric layers on top of one another, and connected to each other in a longitudinal direction by woven hems, to form a cavity, warp threads of the layers have a uniform warp thread density over an entire length of the belt bands, the device comprising:

a power loom having a shedding mechanism with a reed with parallel dents, a woof insertion device extending over an entire width of the power loom, a control unit for controlling the shedding mechanism, and an expander extending over the entire width of the power loom, the expander having a smaller diameter in a tubular area than in a hem area in correspondence with the belt bands to be produced, so that clamping pressure of the expander is substantially constant over an entire width of the woven fabric; and a thermal cutting device having cutting heads operative to cut out the belt bands in the hem area from the woven fabric web.

2. A device according to claim 1, wherein the power loom is configured so that the belt bands are producable with warp threads which are thinner in the hem than other areas of the belt band.

3. A device according to claim 1, wherein the power loom is configured so that the belt bands are producable with warp threads which are thicker in a central area than in laterally adjacent areas.

4. A device according to claim 3, wherein the power loom is configured so that belt bands are produced with warp threads between the hem and the central area which are thinner than the warp threads of the central area.

5. A device according to claim 4, wherein the warp threads between the hem and the central area are thicker than warp threads in the hem.

6. A device according to claim 3, wherein the power loom is configured so that belt bands are produced with warp threads which have greater density on both sides of the central area than in the central area.

7. A device according to claim 1, wherein the power loom is configured so that belt bands are produced which contain tie-off threads at the hems.

8. A device according to claim 1, wherein the shedding mechanism is controlled by the control unit of the power loom so that belt bands of various type can be produced by changing at least one of the position and shape of the woven hem and thereby changing a width of the cavity.

9. A device according to claim 8, wherein the control unit is operative to control the shedding mechanism so that wide and narrow sections of adjacent belt bands are offset with respect to each other.

10. A device according to claim 8, wherein the shedding mechanism and the control unit of the power loom are operatively configured so that belt bands are produced with fabric layers which are connected by breakable tie-off threads in an area of the cavities of greater width, which tie-off threads are provided on both sides of the cavity of the central area.

11. A device according to claim 1, wherein the cutting heads are connected to the control unit by a control line and are movable transversely to the warp threads in correspondence with a selected pattern.

12. A device according to claim 1, wherein the cutting device includes two movable cutting heads between two adjacent belt bands operative to cut out belt bands of varying width with hems of essentially uniform width.

13. A device according to claim 1, wherein the cutting device has one movable cutting head arranged between two adjacent belt bands so as to cut the hem area between the belt bands at least to approximately half an original width.

14. A device according to claim 1, wherein the power loom has a fabric take-up device which includes at least one press roll with areas of different diameter alternating along its length so that clamping pressure or take-off tension of the fabric is substantially constant over the entire width of one of the woven fabric web and the belt bands.

15. A device according to claim 14, and further comprising a heat-setting device arranged one of before and on the product take-up device.

16. A device according to claim 1, wherein the cutting device is installed on the power loom in front of the fabric take-up device in a direction of movement of the belt bands.

17. A device according to claim 1, wherein the cutting device is installed downline from the power loom in a direction of movement of the belt bands.

* * * * *